US010836626B2

(12) United States Patent
Karino et al.

(10) Patent No.: US 10,836,626 B2
(45) Date of Patent: Nov. 17, 2020

(54) VAPOR RECOVERY DEVICE

(71) Applicant: Tatsuno Corporation, Tokyo (JP)

(72) Inventors: Kazuyuki Karino, Tokyo (JP); Al Yuta, Tokyo (JP)

(73) Assignee: TATSUNO CORPORATION, Tokyo (JP)

( * ) Notice: Subject to any disclaimer, the term of this patent is extended or adjusted under 35 U.S.C. 154(b) by 204 days.

(21) Appl. No.: 15/614,393

(22) Filed: Jun. 5, 2017

(65) Prior Publication Data

US 2017/0362075 A1 Dec. 21, 2017

(30) Foreign Application Priority Data

Jun. 15, 2016 (JP) ..... 2016-118769

(51) Int. Cl.
*B67D 7/04* (2010.01)
*B65D 90/30* (2006.01)
*F17C 13/12* (2006.01)

(52) U.S. Cl.
CPC ..... *B67D 7/0476* (2013.01); *B65D 90/30* (2013.01); *B67D 7/049* (2013.01); *F17C 13/12* (2013.01)

(58) Field of Classification Search
CPC ..... B67D 7/0476; B67D 7/049; B65D 90/30; F17C 13/12
See application file for complete search history.

(56) References Cited

U.S. PATENT DOCUMENTS 5,269,833 A * 12/1993 Nitsche ..... B01D 53/04 95/105
5,636,667 A * 6/1997 Young ..... B67D 7/0482 141/59

FOREIGN PATENT DOCUMENTS

JP 05345111 A * 12/1993
JP 2971184 B2 * 11/1999
JP 2014076829 A * 5/2014

OTHER PUBLICATIONS

Corwin et al. ("Controlling trace organic contaminants with GAC adsorption" Journal—American Water Works Association, 104: E36-E47. Published Jan. 1, 2012, https://doi:10.5942/jawwa.2012.104.0004) (Year: 201).*

* cited by examiner

*Primary Examiner* — In Suk C Bullock
*Assistant Examiner* — Jason Y Chong
(74) *Attorney, Agent, or Firm* — Stetina Brunda Garred and Brucker; Mark B. Garred

(57) ABSTRACT

To provide a vapor recovery device capable of making the most of the capacity of the adsorption/desorption towers and efficiently adsorbing and desorbing fuel oil vapor. A vapor recovery device 1 having: a pump 5 disposed on a pipe 4 branched from a vent pipe 3, one end of which being connected to an underground tank 2, to suck a fuel oil vapor V in the underground tank; a condenser 6 connected, on the branch pipe, to a downstream side of the pump to condense the fuel oil vapor; and a plurality of adsorption/desorption towers 7*a*, 7*b*, 8*a*, 8*b* connected, on the branch pipe, to a downstream side of the condenser in series to adsorb/desorb fuel oil vapor fed from the condenser. One of the adsorption/desorption towers can be arranged above another one of remaining adsorption/desorption towers, and the pump may be fixed in a housing 30 through a bottom face and a side face of the pump and elastic bodies 32, 33.

14 Claims, 6 Drawing Sheets

【FIG. 1】
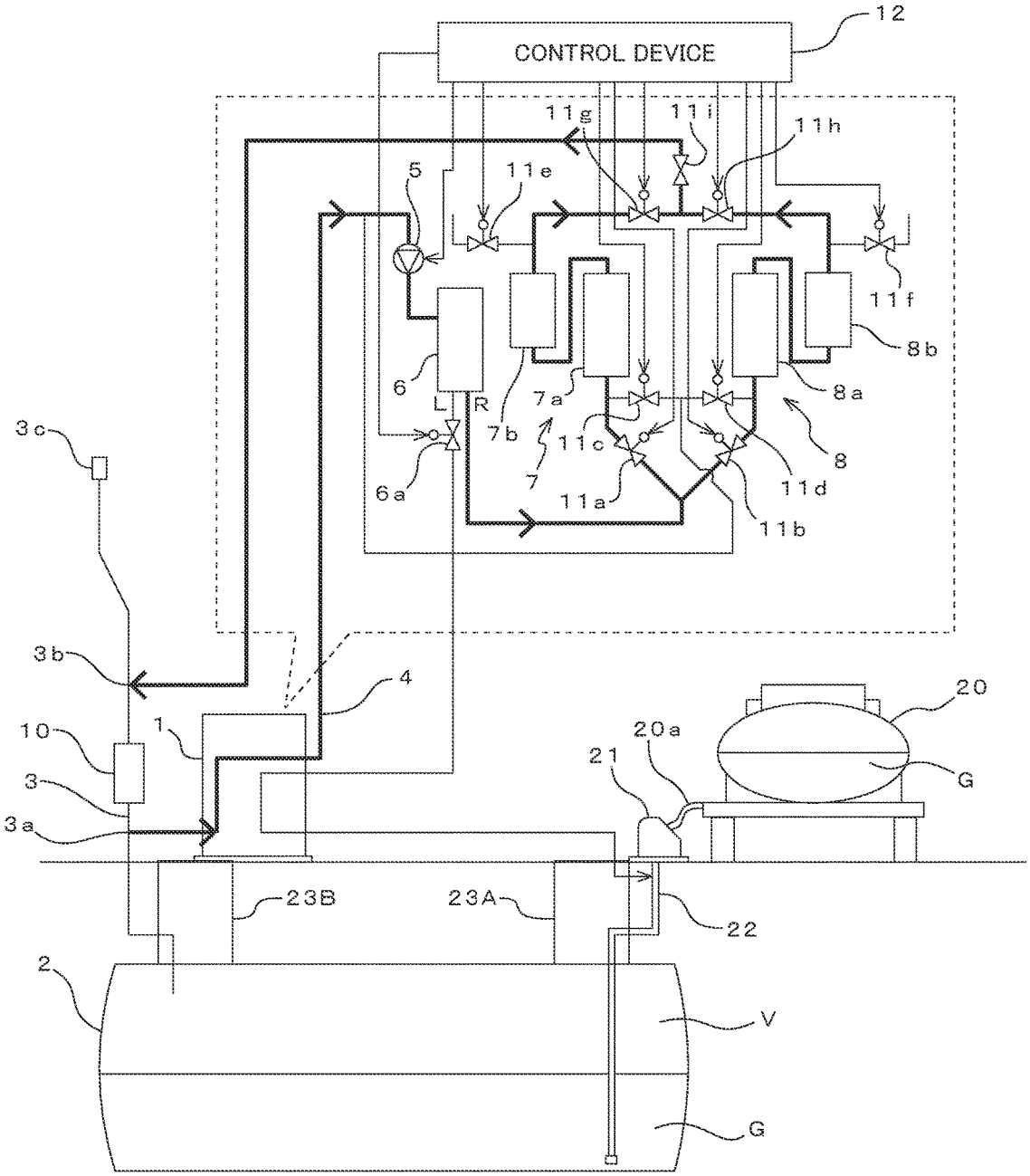

【FIG. 2】
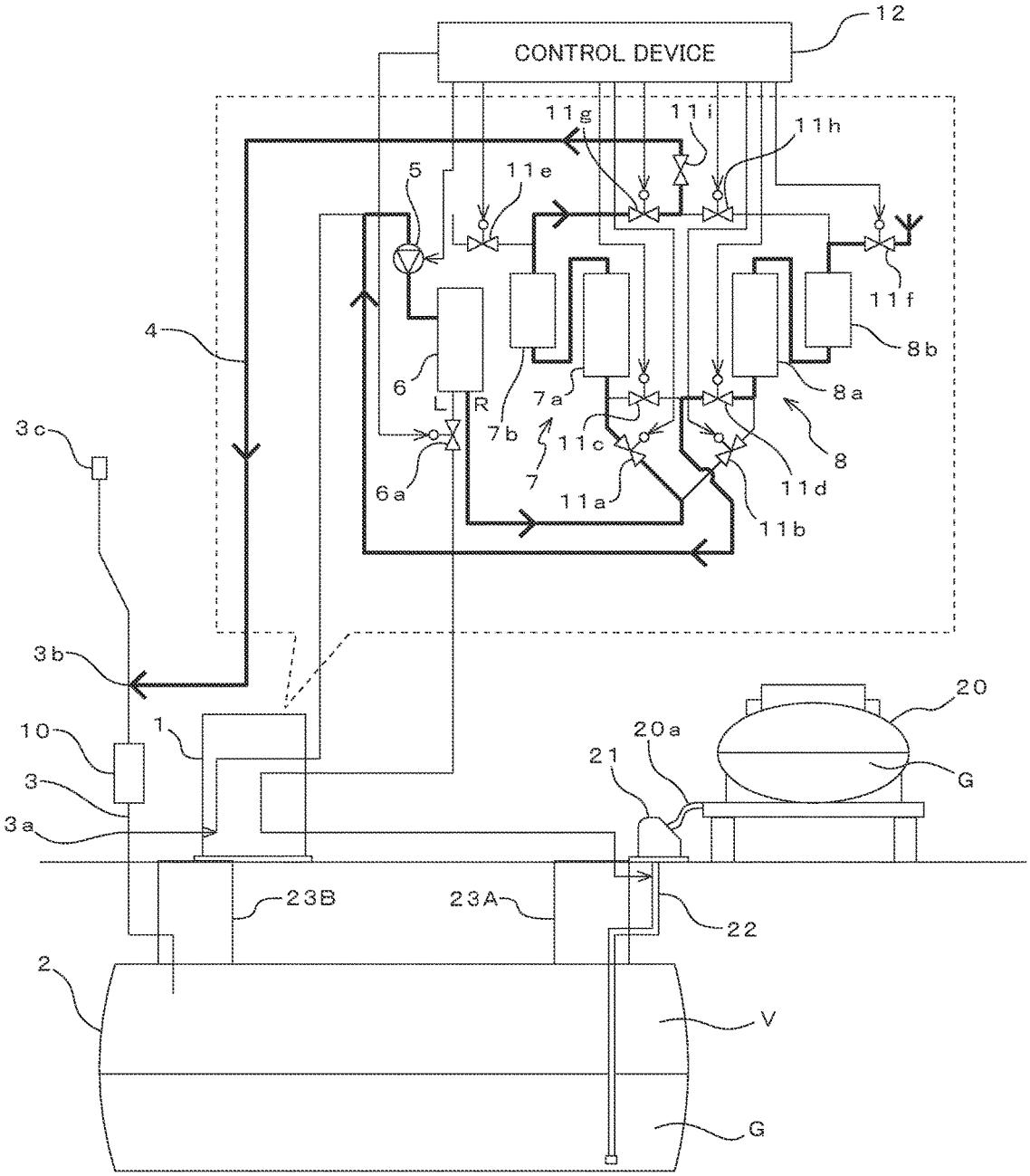

【FIG. 3】
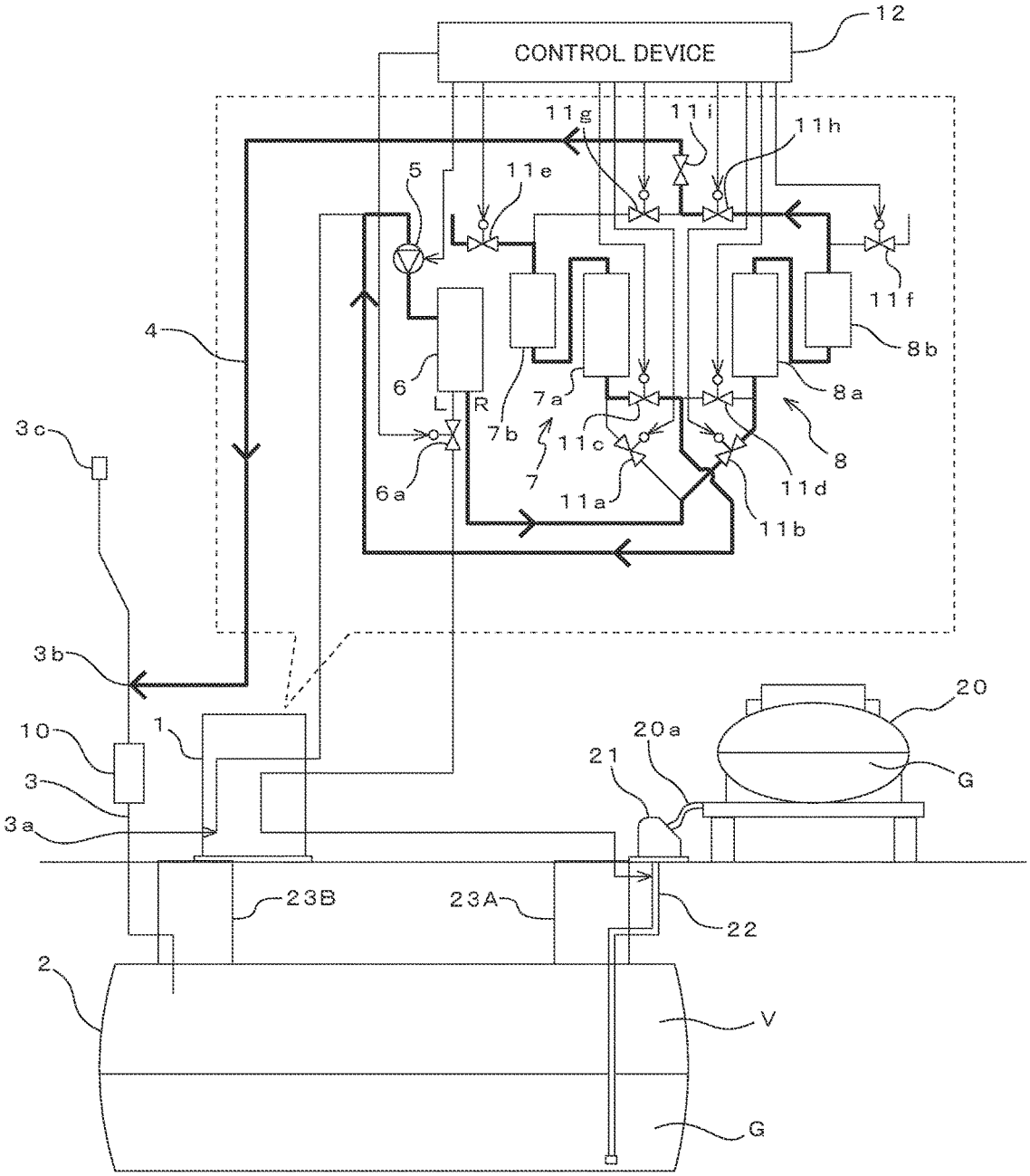

【FIG. 4】
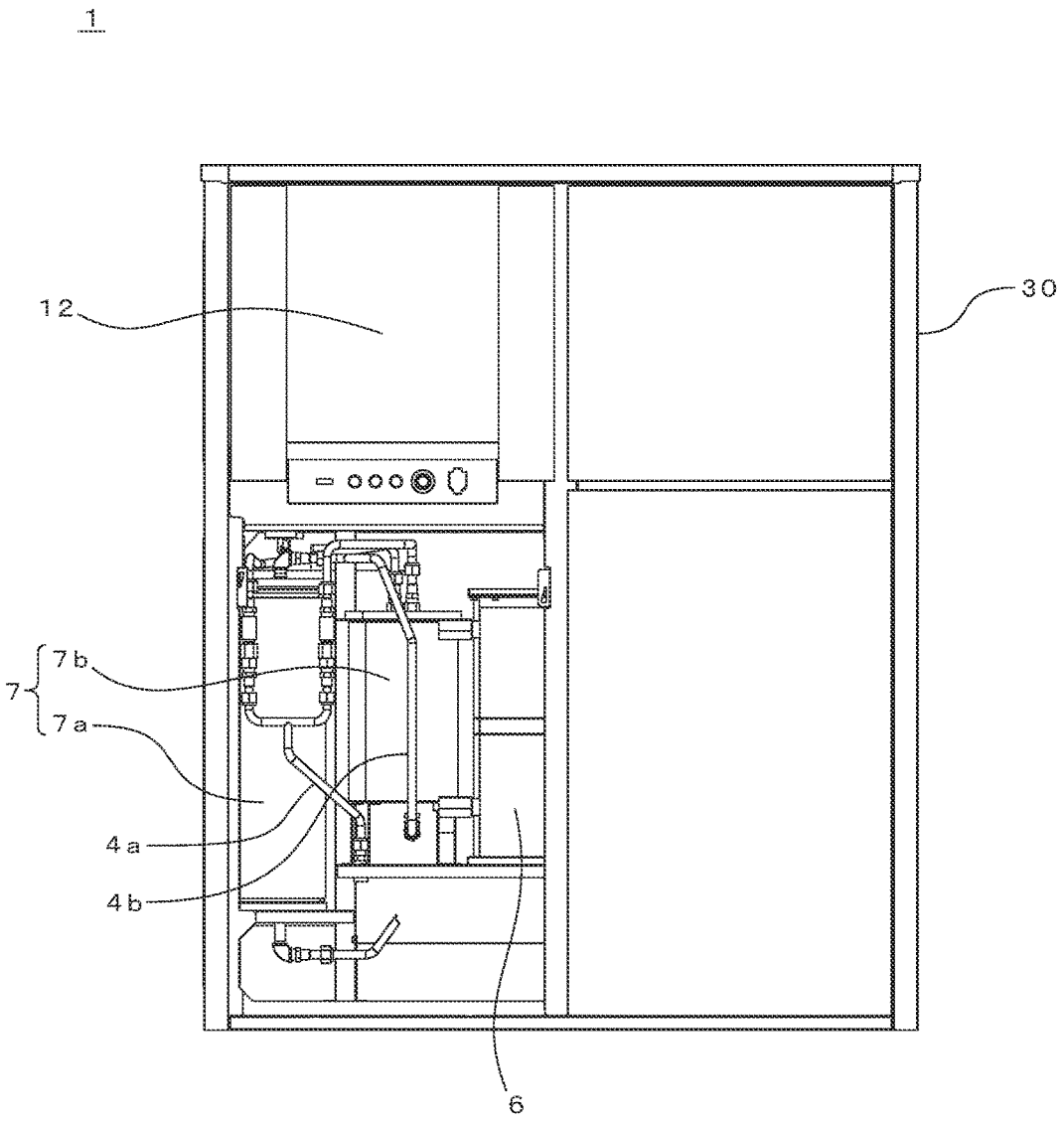

【FIG. 5】
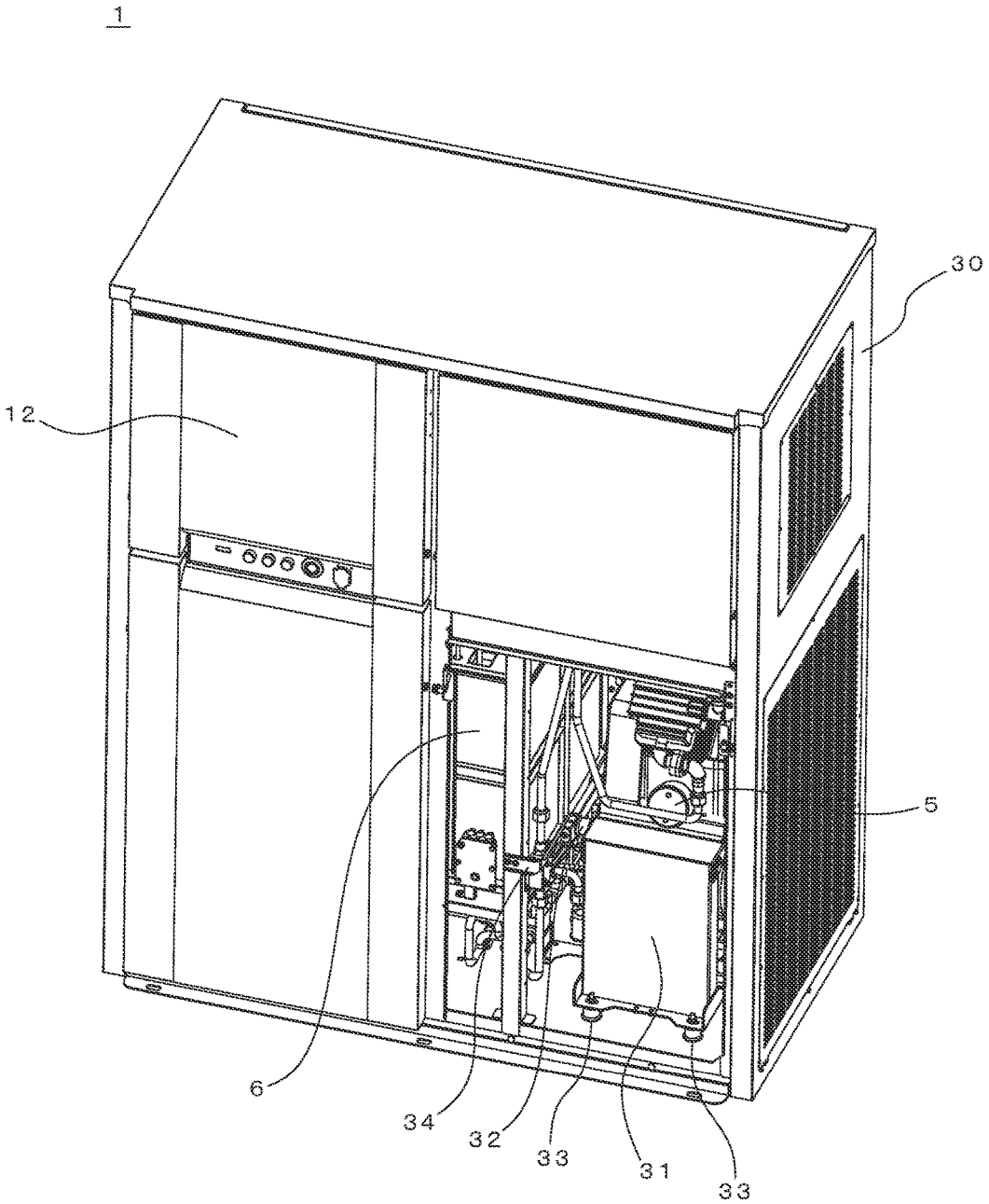

【FIG. 6】
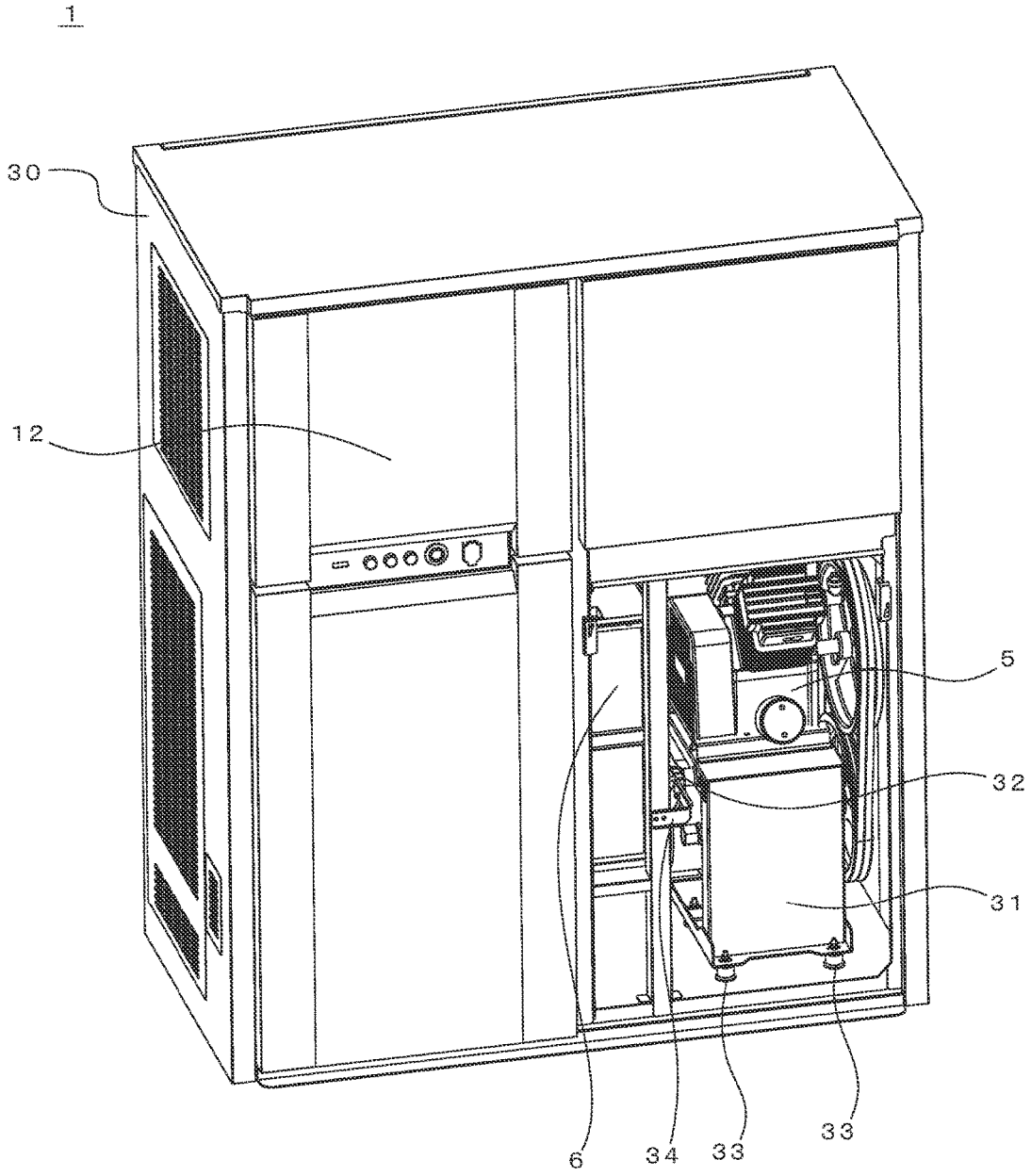

VAPOR RECOVERY DEVICE

CROSS-REFERENCE TO RELATED APPLICATIONS

The present application claims priority to Japanese Patent Application No. 2016-118769 filed on Jun. 15, 2016, the disclosure of which is incorporated herein by reference.

STATEMENT RE: FEDERALLY SPONSORED RESEARCH/DEVELOPMENT

Not Applicable

BACKGROUND OF THE INVENTION

1. Field of the Invention

The present invention relates to a vapor recovery device for automatically recovering a fuel oil vapor (vaporized fuel oil) retaining in an underground tank when a fuel oil is unloaded from a tank truck to the underground tank and so on.

2. Description of the Related Art

In general, since volatilities of fuel oils such as gasoline are high, when a fuel oil was unloaded from a tank truck to an underground tank buried in a gas station, a fuel oil vapor that was hydrocarbons, and that retained in an upper space of the underground tank was conventionally released through a vent pipe connected to the underground tank into the atmosphere. It wasted resources and caused an environment pollution by the fuel oil vapor released into the atmosphere. Further, there was a fear of fire disaster by ignition of the fuel oil vapor released into the atmosphere.

Then, the applicant proposed, in Japanese Patent Publication No. 2016-078893, a vapor recovery device including a compression pump that was disposed to a branching portion branched from a vent pipe, one end of which was connected to an underground tank, and was used for sucking and recovering a fuel oil vapor in the underground tank, and an adsorption/desorption tower, disposed downstream of the compression pump, for condensing the fuel oil vapor, and when the branched portion became an open state the compression pump was activated. With this vapor recovery device, a rotation sensor was unnecessary, and fuel oil vapor was automatically recovered while suppressing cost for equipment investment.

The content of Japanese Patent Publication No. 2016-078893 is incorporated herein by reference in its entirety.

SUMMARY OF THE INVENTION

Although the invention described in the patent publication is effective, when a vapor exceeding capacity of the adsorption/desorption tower is introduced, a part of the introduced vapor is not adsorbed by the adsorption/desorption tower, and is released in the air through the vent pipe as a problem. Therefore, it is necessary to increase the capacity of the adsorption/desorption tower without considerably changing an existing construction. But, when adsorption/desorption towers are mounted in parallel to each other, a vapor is adsorbed to an adsorption/desorption tower with smaller draft resistance only, and in desorption process is desorbed a vapor from the adsorption/desorption tower with smaller draft resistance, so that the condition that only one adsorption/desorption tower is always filled with vapor continues. As a result, although the capacity of the adsorption/desorption towers is increased in construction, the capacity cannot be utilized to maximum, so that there is room for improvement.

Then, the object of the present invention is to provide a vapor recovery device capable of making the most of the capacity of the adsorption/desorption towers and efficiently adsorbing and desorbing fuel oil vapor.

In order to attain the above-mentioned object, a vapor recovery device according to the present invention is characterized by comprising: a pump disposed on a pipe branched from a vent pipe, one end of which being connected to an underground tank, to suck a fuel oil vapor in the underground tank; a condenser connected, on the branch pipe, to a downstream side of the pump to condense the fuel oil vapor; and a plurality of adsorption/desorption towers connected, on the branch pipe, to a downstream side of the condenser in series to adsorb/desorb a fuel oil vapor fed from the condenser.

With the present invention, since a plurality of adsorption/desorption towers are connected in series, unevenness in adsorption amount/desorption amount among the adsorption/desorption towers, which is generated when the adsorption/desorption towers are connected in parallel, is eliminated, which allows the capacity of the adsorption/desorption towers to be used sufficiently, resulting in efficient recovery of the fuel oil vapor.

In the above vapor recovery device, one of the adsorption/desorption towers can be arranged above another one of remaining adsorption/desorption towers. With this, even when a liquid pool of gasoline is generated in pipes, the liquid can be discharged with ease.

In addition, the pump can be fixed in a housing through a bottom face and a side face of the pump and elastic bodies, which prevents generation of abnormal noise due to vibration of the pump and avoids transmission of vibration to other devices.

Further, the elastic body on the side face side of the pump can be softer than the elastic body on the bottom face side of the pump, which prevents sympathetic vibrations and absorbs vibration more efficiently, and avoids transmission of vibration to the condenser and the adsorption/desorption towers.

Still further, the above vapor recovery devices can further comprise a bracket for supporting the elastic body on the side face side of the pump, and the bracket may be divided into a plurality of parts, which enables easy maintenance work.

As described above, with the present invention, the capacity of the adsorption/desorption towers can be maximized, and it is possible to provide a vapor recovery device capable of efficiently adsorbing and desorbing fuel oil vapor.

BRIEF DESCRIPTION OF THE DRAWINGS

FIG. 1 is a schematic view showing a vapor recovery device according to an embodiment of the present invention to explain adsorbing motion at unloading;

FIG. 2 is a drawing for explaining an example of desorbing motion after unloading in the vapor recovery device shown in FIG. 1;

FIG. 3 is a drawing for explaining another example of desorbing motion after unloading in the vapor recovery device shown in FIG. 1;

FIG. 4 is a front view showing an example of concrete construction of a vapor recovery device according to the present invention;

FIG. 5 is a perspective view of the vapor recovery device shown in FIG. 4; and FIG. 6 is a perspective view of the vapor recovery device shown in FIG. 4.

DETAILED DESCRIPTION OF THE INVENTION

Next, an embodiment of the present invention will be explained with reference to figures in detail.

FIG. 1 shows a vapor recovery device according to an embodiment of the present invention, and the vapor recovery device 1 includes a compression pump 5 disposed on a branch pipe 4 branched from a vent pipe 3, one end of which is connected to an underground tank 2, via a branching point 3*a* and joins the vent pipe 3 via a confluence point 3*b* to suck a gasoline vapor V staying in the underground tank 2; a condenser 6 for condensing the gasoline vapor V from the compression pump 5; and the first and second adsorption/desorption tower groups 7, 8 for adsorbing/desorbing a residual vapor R fed from the condenser 6; and so on.

Between the branching point 3*a* and the confluence point 3*b* of the vent pipe 3 is mounted a bent valve 10, and at an upper end of the vent pipe 3 is drilled a vent hole 3*c*. The vent valve 10 does not open unless it becomes more or equal to a predetermined pressure (abnormal pressure), so that the gasoline vapor V from the underground tank 2 normally flows to the branch pipe 4 from the branching point 3*a*.

The compression pump 5 is manually or automatically activated when unloading of a fuel oil G starts, and manually or automatically stops when the unloading is finished. The compression pump 5 sucks and recovers the gasoline vapor V through the branch pipe 4, and discharges the sucked and recovered gasoline vapor V to the condenser 6 described below. In this connection, any pump capable of sucking the gasoline vapor V can be used other than the compression pump.

The condenser 6 is mounted to condense the gasoline vapor V, and the gasoline vapor V is separated into a liquefied gasoline L and the residual vapor R that remains in gasoline vapor state without being liquefied. Liquefaction of the gasoline vapor V is, for example, performed by using an external cooling means or circulating the gasoline itself in the condenser 6.

On a downstream side of the condenser 6 is attached a liquid returning valve 6*a*. Opening this liquid returning valve 6*a* allows the liquefied gasoline L by the condenser 6 to be guided to the underground tank 2, on the other hand, closing the liquid returning valve 6*a* allows the residual vapor R separated by the condenser 6 to be guided to the first and second adsorption/desorption tower groups 7, 8.

The first and second adsorption/desorption tower groups 7, 8 are provided in parallel, and the first adsorption/desorption tower group 7 includes two adsorption/desorption towers 7*a*, 7*b* that are connected with each other in series, and the second adsorption/desorption tower group 8 includes two adsorption/desorption towers 8*a*, 8*b* that are connected with each other in series.

Each adsorption/desorption tower 7*a*, 7*b*, 8*a*, 8*b* has an adsorption function that adsorbs only gasoline components from the residual vapor R consisting of the gasoline components and air components, which are supplied from the condenser 6, and separates residual air components from the gasoline components, and a desorption function that desorbs the gasoline components adsorbed. The air components are released outside from the vent hole 3*c* of the vent pipe 3. In order to change the adsorption function and the desorption function, on pipes to which adsorption/desorption towers 7*a*, 7*b*, 8*a*, 8*b* are mounted a plurality of two-way valves 11 (11*a*-11*i*).

Further, in the first and second adsorption/desorption tower groups 7, 8, the adsorption/desorption tower 7*b* is arranged above the adsorption/desorption tower 7*a* (higher in position), and the adsorption/desorption tower 8*b* is arranged above the adsorption/desorption tower 8*a* (higher in position), which causes connection pipes of the adsorption/desorption towers 7*a*, 7*b* and connection pipes of the adsorption/desorption towers 8*a*, 8*b* to be arranged high in position (in a direction apart from the ground), so that even if a pool of the liquefied gasoline L is generated in the pipes, the liquefied gasoline L can preferably be discharged with ease.

A control device 12 is mounted to control start/stop of the compression pump 5 and opening/closing of the liquid returning valve 6*a* and the two-way valves 11 and so on.

A tank truck 20 has at least one unloading hose 20*a*, and at least one distant oiling pipe 22 connected to the underground tank 2 is disposed in an oiling port box 21. A gasoline G loaded on the tank truck 20 is filled via the unloading hose 20*a* and the distant oiling pipe 22 into the underground tank 2 to be stored therein.

To the underground tank 2 are mounted a couple of joints 23 (23A, 23B); to the right side joint 23A is attached the distant oiling pipe 22 extending from the oiling port box 21 to the underground tank 2; and to the left side joint 23B is attached the vent pipe 3 so as to be connected to the underground tank 2 and extend to the ground.

FIGS. 4 to 6 show a concrete construction example of the vapor recovery device 1; at an upper left portion of a rectangular housing main body 30 is arranged the control device 12; below the control device 12 is mounted the first adsorption/desorption tower group 7 (the adsorption/desorption tower 7*a*, 7*b*) are arranged; and behind the first adsorption/desorption tower group 7 are arranged the second adsorption/desorption tower group 8 (the adsorption/desorption towers 8*a*, 8*b*) not shown. As shown in FIG. 4, since the adsorption/desorption tower 7*b* is arranged above (higher position) the adsorption/desorption tower 7*a*, the connection pipes 4*a*, 4*b* of the adsorption/desorption tower 7*a*, 7*b* are arranged at higher position (in a direction upwardly apart from the ground), so that even if a pool of the liquefied gasoline L is generated in the pipes 4*a*, 4*b*, the liquefied gasoline L can be discharged with ease.

On a lower right portion of the housing main body 30 is mounted the compression pump 5, and below the compression pump 5 is disposed a motor 31 for driving/stopping the compression pump 5, and on the left side of the compression pump 5 is arranged the condenser 6.

When the motor 31 is driven, its vibration is transferred to the compression pump 5 to be a cause of abnormal sound, so that on a side face and a bottom face of the compression pump 5 are attached elastic bodies 32, 33 such as rubber for absorbing the vibration. Here, forming the elastic body 32 on the side face side is softer than the elastic body 33 on the bottom face side prevents sympathetic vibrations and absorbs vibration more efficiently, and avoids transmission of vibration to the condenser 6 and the adsorption/desorption tower groups 7, 8.

Further, the elastic body 32 on the side face side is supported by a bracket 34, and the bracket 34 is formed to be dividable into a plurality of parts, which realizes easy maintenance work of the bracket 34.

Next, motion of the vapor recovery device 1 with the above construction will be explained with reference to drawings.

In FIG. 1, when unloading of a gasoline G from a tank truck 20 starts, the control device 12 opens the two-way valves 11*a*, 11*b*, 11*g*, 11*h*, 11*i* and closes the two-way valves 11*c*, 11*d*, 11*e*, 11*f*, and the compression pump 5 is activated.

With the above motion, the gasoline vapor V staying in the underground tank 2 flows in the branch pipe 4 and is condensed in the condenser 6, then a liquefied gasoline L returns to the underground tank 2 through the liquid returning valve 6*a* and the distant oiling pipe 22.

On the other hand, the residual vapor R that is not liquefied in the condenser 6 is introduced to the first and second adsorption/desorption tower groups 7, 8, and firstly gasoline components included in the residual vapor R is adsorbed in the adsorption/desorption towers 7*a*, 8*a*, and when the quantity of the residual vapor R exceeds the capacity of the adsorption/desorption towers 7*a*, 8*a*, gasoline components of the residual vapor R is adsorbed in the adsorption/desorption towers 7*b*, 8*b* in the next stage. Like this, since the adsorption/desorption towers 7*a*, 7*b* and the adsorption/desorption towers 8*a*, 8*b* are connected in series, deviation in amount of adsorption among the adsorption/desorption towers, which is generated when the adsorption/desorption towers are connected in parallel, can be eliminated, and it becomes possible to sufficiently make use of the capacity of the adsorption/desorption towers.

Then, air components separated from the residual vapor R returns to the vent pipe 3 through the confluence point 3*b* of the vent pipe 3, and is released into the air from the vent hole 3*c*

Next, the motion of desorbing gasoline components adsorbed in the adsorption/desorption towers 7*a*, 7*b*, 8*a*, 8*b* as described above will be explained with reference to FIGS. 2 and 3.

When the unloading of gasoline from the tank truck 20 is finished, as shown in FIG. 2, by the control device 12 are opened the two-way valves 11*a*, 11*d*, 11*f*, 11*g*, 11*i*, and are closed the two-way valves 11*b*, 11*c*, 11*e*, 11*h*, and air is introduced to the second adsorption/desorption tower group 8 from the two-way valve 11*f*.

With the above motion, gasoline components are desorbed from the adsorption/desorption tower 8*b* of the second adsorption/desorption tower group 8, and after that, gasoline components are desorbed from the adsorption/desorption tower 8*a*. Like this, since the adsorption/desorption tower 8*a* and the adsorption/desorption tower 8*b* are connected in series, deviation in amount of desorption among the adsorption/desorption towers, which is generated when the adsorption/desorption towers are connected in parallel, can be eliminated, and it becomes possible to sufficiently make use of the capacity of the adsorption/desorption towers.

The gasoline components desorbed from these adsorption/desorption towers 8*a*, 8*b* return to the condenser 6 through the compression pump 5 together with air, and the liquefied gasoline L liquefied through the condensation in the condenser 6 returns to the underground tank 2 through the liquid returning valve 6*a* and the distant oiling pipe 22. On the other hand, the air returns to the vent pipe 3 via the confluence point 3*b* of the vent pipe 3, and is released into the air via the vent hole 3*c*.

After several minutes of desorption motion in the second adsorption/desorption tower group 8, as described in FIG. 3, by the control device 12 are closed the two-way valves 11*a*, 11*d*, 11*f*, 11*g*, and are opened the two-way valves 11*b*, 11*c*, 11*e*, 11*h*, 11*i*, and air is introduced to the first adsorption/desorption tower group 7 from the two-way valve 11*e*, and in the same manner as described above, desorption motion in the first adsorption/desorption tower group 7 is performed for several minutes. In this case also, since the adsorption/desorption tower 7*a* and the adsorption/desorption tower 7*b* are connected in series, deviation in amount of adsorption among the adsorption/desorption towers, which is generated when the adsorption/desorption towers are connected in parallel, can be eliminated, and it becomes possible to sufficiently make use of the capacity of the adsorption/desorption towers. Like this, performing desorbing motion while exchanging the first adsorption/desorption tower group 7 or the second adsorption/desorption tower group 8 under desorption operation completes desorbing motion in the adsorption/desorption towers 7*a*, 7*b*, 8*a* and 8*b*.

As described above, with the embodiment, the capacity of the adsorption/desorption towers can be utilized to maximum, which allows fuel vapor to efficiently be adsorbed and desorbed.

Meanwhile, shape and connecting structure of each element explained in the above embodiment are merely examples, and any structure can be used without departing from the scope and spirit of this invention.

1 vapor recovery device
2 underground tank
3 vent pipe
3*a* branching point
3*b* confluence point
3*c* vent hole
4 branch pipe
5 compression pump
6 condenser
6*a* liquid returning valve
7 first adsorption/desorption tower group
7*a*, 7*b* adsorption/desorption towers
8 second adsorption/desorption tower group
8*a*, 8*b* adsorption/desorption towers
10 vent valve
11 (11*a*-11*f*) two-way valves
12 control device
20 tank truck
20*a* unloading hose
21 oiling port box
22 distant oiling pipe
23 (23A, 23B) joints
30 housing main body
31 motor
32, 33 elastic bodies
34 bracket
G fuel oil (gasoline)
L liquefied gasoline
R residual vapor
V fuel oil vapor (gasoline vapor)

What is claimed is:

1. A vapor recovery device comprising:

a vent pipe having one end connectable to an underground tank to suck a fuel oil vapor from the underground tank;

a branch pipe having a first end connected to the vent pipe;

a pump disposed on the branch pipe;

a condenser disposed on the branch pipe and arranged downstream of the pump to condense the fuel oil vapor;

a first tower pipe and a second tower pipe each having a first end connected to a second end of the branch pipe;

a first plurality of adsorption/desorption towers arranged in series relative to each other and disposed on the first tower pipe, and a second plurality of adsorption/desorption towers arranged in series relative to each other and disposed on the second tower pipe, wherein the first plurality of adsorption/desorption towers are arranged in parallel to the second plurality of adsorption/desorption towers, each of the first plurality and second plurality of adsorption/desorption towers having an upper end and a lower end;

a discharge pipe having a first end connected to both a second end of the first tower pipe and a second end of the second tower pipe, the discharge pipe having a second end connected to the vent pipe; and a return pipe having a first end connected to a portion of the branch pipe between the first end of the branch pipe and the pump, having a second end connected to the lower end of the first plurality of adsorption/desorption towers, and having a third end connected to the lower end of the second plurality of adsorption/desorption towers;

wherein the vapor recovery device is configured to be operable in an adsorption mode, a first desorption mode, and a second desorption mode:

in the adsorption mode a residual vapor is introduced into the lower ends of the first plurality and second plurality of adsorption/desorption towers and exits via the upper ends of the first plurality and second plurality of adsorption/desorption towers;

in the first desorption mode, fuel oil is desorbed from the second plurality of adsorption/desorption towers with a fluid flowing through the second plurality of adsorption/desorption towers from the upper end to the lower end thereof, then through the condenser via the return pipe, and then through the first plurality of adsorption/desorption towers from the lower end to the upper end thereof; and in the second desorption mode, fuel oil is desorbed from the first plurality of adsorption/desorption towers with a fluid flowing through the first plurality of adsorption/desorption towers from the upper end to the lower end thereof, then through the condenser via the return pipe, and then through the second plurality of adsorption/desorption towers from the lower end to the upper end thereof.

2. The vapor recovery device as claimed in claim 1, wherein the first plurality and/or second plurality of adsorption/desorption towers are arranged such that one of said adsorption/desorption towers is arranged to have at least a portion thereof below another one of the remaining adsorption/desorption towers.

3. The vapor recovery device as claimed in claim 2, wherein said pump is fixed in a housing through a bottom face and a side face of said pump and elastic bodies.

4. The vapor recovery device as claimed in claim 3, wherein an elastic body on the side face of the pump is softer than an elastic body on the bottom face of the pump.

5. The vapor recovery device as claimed in claim 4 further comprising a bracket for supporting said elastic body on the side face of the pump, said bracket being divided into a plurality of parts.

6. The vapor recovery device as claimed in claim 1, wherein said pump is mounted to a housing through a bottom face and a side face of said pump and elastic bodies.

7. The vapor recovery device as claimed in claim 6, wherein an elastic body on the side face of the pump is of a hardness less than an elastic body on the bottom face of the pump.

8. The vapor recovery device as claimed in claim 7 further comprising a bracket for supporting said elastic body on the side face of the pump, said bracket being divided into a plurality of parts.

9. The vapor recovery device as claimed in claim 6 further comprising a bracket for supporting said elastic body on the side face of the pump, said bracket being divided into a plurality of parts.

10. The vapor recovery device as claimed in claim 1, further comprising:

a first two-way valve on the first tower pipe such that said first two-way valve is disposed fluidly between the condenser and the first plurality of adsorption/desorption towers; and a second two-way valve on the second tower pipe such that said two-way valve is disposed fluidly between the condenser and the second plurality of adsorption/desorption towers.

11. The vapor recovery device as claimed in claim 10, further comprising:

a third two-way valve positioned on the first tower pipe such that the first plurality of adsorption/desorption towers are located fluidly between the first and third two-way valves; and a fourth two-way valve positioned on the second tower pipe such that the second plurality of adsorption/desorption towers are located fluidly between the second and fourth two-way valves.

12. The vapor recovery device as claimed m claim 11, further comprising:

a fifth two-way valve positioned fluidly between a first ambient inlet and the upper end of the first plurality of adsorption/desorption towers; and a sixth two-way valve positioned fluidly between a second ambient inlet and the upper end of the second plurality of adsorption/desorption towers.

13. The vapor recovery device as claimed in claim 12, further comprising:

a seventh two-way valve on the return pipe such that said seventh two-way valve is disposed fluidly between the pump and the first plurality of adsorption/desorption towers, wherein said seventh two-way valve is configured to control flow of a fluid from the first plurality of adsorption/desorption towers to the condenser during the second desorption mode; and an eighth two-way valve on the return pipe such that said eighth two-way valve is disposed fluidly between the pump and the second plurality of adsorption/desorption towers, wherein said eighth two-way valve is configured to control flow of a fluid from the second plurality of adsorption/desorption towers to the condenser during the first desorption mode.

14. The vapor recovery device as claimed in claim 13, further comprising a control device in operative communication with the first, second, third, fourth, fifth, sixth, seventh, and eighth two-way valves, the control device being configured to facilitate a first operative mode and a second operative mode, in the first operative mode, the first, third, sixth, and eighth two-way valves are open, and the second, fourth, fifth, and seventh, two-way valves are closed to allow air received via the sixth two-way valve to be introduced to the second plurality of adsorption/desorption towers;

in the second operative mode, the first, third, sixth, and eighth two-way valves are closed, and the second, fourth, fifth, and seventh two-way valves are open to allow air received via the fifth two-way valve to be introduced to the first plurality of adsorption/desorption towers.

* * * * *